US005303008A

United States Patent [19]

Kalyandurg et al.

[11] Patent Number: 5,303,008

[45] Date of Patent: Apr. 12, 1994

[54] SEAL-FORMING DEVICE FOR A TONER RECEIVING APERTURE

[75] Inventors: Satyan R. Kalyandurg; Richard S. Fox, both of Rochester; Blaise P. Pelligra, Webster, all of N.Y.

[73] Assignee: Eastman Kodak Company, Rochester, N.Y.

[21] Appl. No.: 895,303

[22] Filed: Jun. 8, 1992

[51] Int. Cl.[5] ..... G03G 21/00

[52] U.S. Cl. ..... 355/215; 277/230; 355/260; 222/DIG. 1

[58] Field of Search ..... 355/215, 260; 222/DIG. 1, 153; 277/227, 228, 230

[56] References Cited

U.S. PATENT DOCUMENTS

| | | | |
|---|---|---|---|
| 2,165,296 | 7/1939 | Oass | 277/230 |
| 2,766,055 | 10/1956 | Poltorak | 277/230 |
| 4,189,985 | 2/1980 | Harris | 277/230 X |
| 4,441,636 | 4/1984 | Yamashita et al. | 222/541 |
| 4,937,628 | 6/1990 | Cipolla et al. | 355/260 |
| 4,972,887 | 11/1990 | Hacknauer et al. | 141/346 |
| 5,029,316 | 7/1991 | Koiso | 355/299 |
| 5,030,998 | 7/1991 | Shibata et al. | 355/260 |

FOREIGN PATENT DOCUMENTS 44688 2/1991 Japan .

*Primary Examiner*—Benjamin R. Fuller
*Assistant Examiner*—J. E. Barlow, Jr.
*Attorney, Agent, or Firm*—Lawrence P. Kessler

[57] ABSTRACT

A seal-forming device for a replenishment toner receiving aperture of a development apparatus includes a resilient member mounted to the development apparatus and around the aperture. The seal-forming device also includes a woven fabric that is mounted to the resilient member and to a part of the development apparatus. The woven fabric has warp and filling fibers. The warp fibers are larger than the filling fibers and are mounted to lie in the direction of loading and unloading a replenishment toner container relative to the seal-forming device.

10 Claims, 7 Drawing Sheets

SEAL-FORMING DEVICE FOR A TONER RECEIVING APERTURE

BACKGROUND OF THE INVENTION

1. Field of the Invention

This invention relates to development apparatus which use dry developer material or toner for developing latent images in such electrostatographic reproduction machines as copiers and printers. More particularly, the present invention relates to a device for sealing around an aperture (used in such development apparatus) for replenishing the developer material or toner as such material or toner is used up in image development.

2. Background Art

Development apparatus, which hold and use dry powdery developer material consisting of, or containing, toner particles at a desired concentration for developing latent images in electrostatographic reproduction machines, are well known. Because such image development ordinarily depletes or uses up toner particles, additional toner particles must frequently be added to the development apparatus in order to maintain their desired concentration. The higher the speed and volume of the host reproduction machine of the development apparatus, or the larger and more solid the toned image areas, the higher the toner depletion rate, and hence the greater the frequency of adding or replenishing toner particles to the development apparatus.

The adding or replenishing of dry, powdery toner particles as such, ordinarily can be a messy job. Therefore unique toner containers as disclosed for example in U.S. Pat. No. 4,972,887 ( '887 patent) have been disclosed in order to make the job less messy. The disclosed toner container therein includes a mouth with a flanged lip portion which cooperates with a toner receiving part of a development apparatus. The toner receiving part of the development apparatus includes a replenishment aperture through which toner from the container passes or drops into the development apparatus. To add or replenish toner to the development apparatus, the toner container is inverted and its flanged lip portion (while still closed) is positioned on the toner receiving part and slid in a forward direction to a (usually open) content-discharging position over the replenishment aperture. To remove the container from over the toner receiving or replenishment aperture, for example, after it is completely discharged, the flanged lip portion thereof is slid in a reverse direction away from the aperture.

In the '887 patent, in order to prevent toner spillage and leakage through areas between the lips of the toner container and the toner receiving part of the development apparatus, it is suggested generally that the surface area of the toner receiving part surrounding the toner receiving or replenishment aperture can be covered with a cloth, felt, fiber or other compressible material acting as a sealing device. Unfortunately, however, as the frequency of sliding the lip portion of a toner container back and forth increases in newer, high speed and high volume reproduction machines, the physical integrity of such a sealing device can quickly deteriorate leading to undesirable leaking of toner particles into open areas of the machines. Additionally, forces required for, and hence the difficulty of, sliding the container onto and away from the replenishment aperture become serious concerns.

SUMMARY OF THE INVENTION

It is, therefore, an object of the present invention to provide a device for forming a seal around a toner receiving aperture and between a toner receiving part of a development apparatus and a toner container being loaded and unloaded in contact with the sealing device such that the loading and unloading of the container is easy to accomplish.

It is also an object of the present invention to provide such a seal forming device which maintains its physical integrity and sealing effectiveness even in a reproduction machine which has a high toner depletion rate and therefore requires frequent loading and unloading of toner containers thereover.

In accordance with the present invention, such a seal forming device comprises a resilient member for mounting to the surface of the toner receiving part of a development apparatus and around a toner receiving aperture in the receiving part. The seal forming device also comprises a woven fabric mounted onto the resilient member for forming a loading and unloading contact surface with a toner container being loaded onto and unloaded from the receiving aperture. The woven fabric has filling fibers that have a different cross sectional area from its warp fibers so as to create a low friction surface that has low areas and high areas.

The invention, and its objects and advantages, will become more apparent in the detailed description of the preferred embodiment presented below.

BRIEF DESCRIPTION OF THE DRAWINGS

In the detailed description of the preferred embodiment presented below, reference is made to the drawings in which.

DETAILED DESCRIPTION OF THE PREFERRED EMBODIMENT

Because electrostatographic reproduction machines and development apparatus for use therein are well known, the present description will be directed in particular to elements thereof which form part of or cooperate more directly with the present invention. Elements thereof not specifically shown or described herein are assumed selectable from those known in the prior art.

Figure 1:
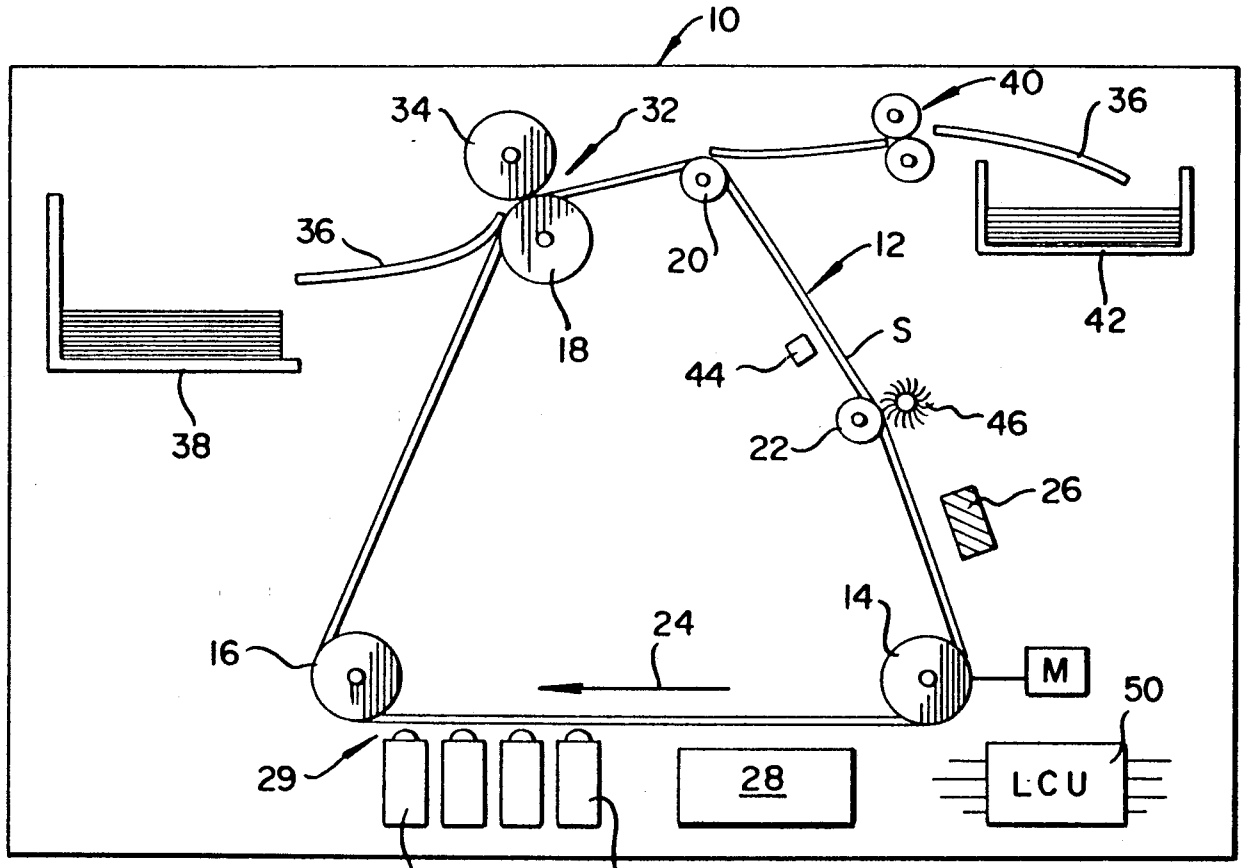
FIG. 1 is a schematic of an electrostatographic reproduction machine including the development apparatus of the present invention.

Referring now to FIG. 1, an electrostatographic reproduction apparatus or machine such as a copier or printer is shown generally as 10. The reproduction apparatus or machine 10 includes an imaging member 12 that has imaging areas on a surface S. The imaging member 12 is shown in the form of an endless photoconductive web that is trained about a number of transport rollers 14, 16, 18, 20 and 22. The roller 14 is a drive roller coupled to a drive motor M for moving the imaging member 12 around a closed path about the transport rollers in the direction shown by arrow 24. Movement of the imaging member 12, as such, causes each successive imaging area on the surface S to sequentially pass a series of electrostatographic process stations positioned about the closed path of the member 12.

As shown, the process stations include a charging station 26, an exposure station 28, a toner development station 29 that includes the development apparatus 30 of the present invention, and a toner image transfer station 32. As is well known in the art, a uniform layer of electrostatic charges is deposited on each area of the surface S at the charging station 26. At the exposure stations 28, portions of each charged imaging area of such surface is imagewise exposed in order to form a latent electrostatic image of an original image being copied or reproduced. At the development station 29, an apparatus such as the development apparatus 30 of the present invention (to be described below) applies developer material which contains suitably charged toner particles to the latent image. The charged toner particles are attracted to the latent image thereby developing or forming a transferable toner image on the surface S. Such development depletes or uses up the toner, which therefore has to be replenished. At the transfer station 32, the toner image is transferred, for example using a transfer drum 34 as is well known, to one side of a receiver sheet 36 that is fed seriatim and in registration from a supply 38 of such sheets to the transfer station 32.

The receiver or copy sheet 36 is then stripped from the surface S following such image transfer and transported to a heated fuser assembly 40 where the toner image is fused and fixed to the copy sheet 36. The copy sheet thereafter is fed to an output finishing area (not shown) or to an output tray 42. Meanwhile, the portion or area of the surface S from which the toner image was transferred is moved past an erase lamp 44 and a cleaning element 46 in order to prepare such portion for forming and transferring another image.

As is known in the art, the reproduction apparatus 10 may include a logic and control unit (LCU) 50 for monitoring and controlling the sequential operations of the elements of the various stations, as well as other functions of the machine 10.

Figure 2:
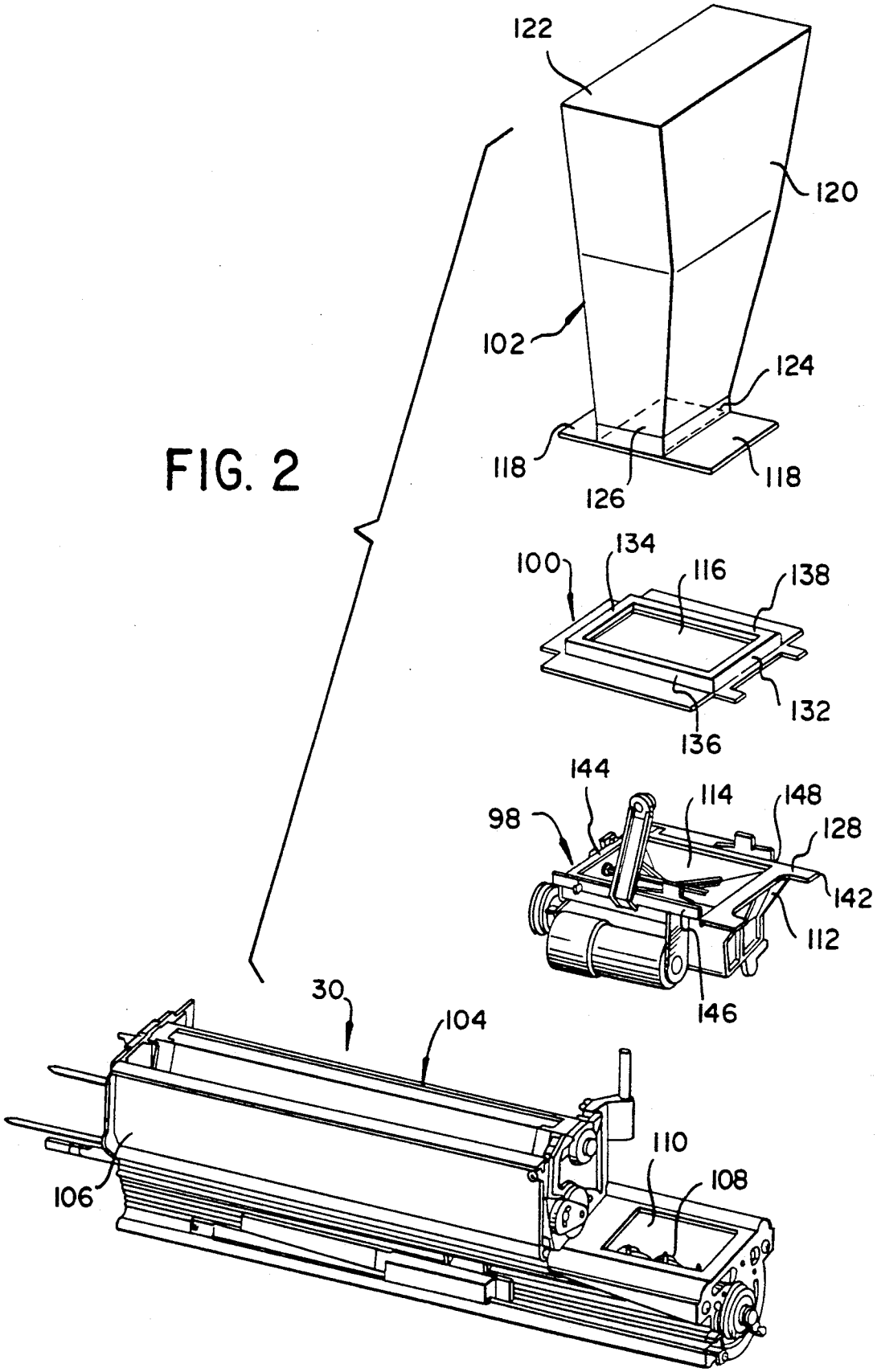
FIG. 2 is an exploded view of the development apparatus of the present invention including the developer receiving part of such apparatus, the seal forming device of the present invention, and a toner container in an inverted position as usable on the present invention.

Referring now to FIG. 2, the development apparatus 30 of the present invention as used in the machine 10, is shown in an exploded view together with (a) a toner or developer receiving part shown generally as 98; (b) the seal forming device of the present invention shown as 100; and (c) a toner or developer container 102 in an inverted position for loading onto the receiving part 98. The development apparatus 30 comprises a first part 104 which includes a housing 106, a mixing device 108 and applying means (not shown) for holding, mixing and applying developer material to latent images on the surface S of imaging member 12. The development apparatus 30 also comprises a second part consisting of the toner receiving part 98. The second part 98 when assembled to the first part 104 is mounted to the housing 106 over a first toner receiving aperture 110 which opens into a toner mixing chamber in the housing 106. As shown, the toner receiving part 98 comprises a generally rectangular hopper portion 112 that has a second generally rectangular toner receiving aperture 114 and defines a passageway through which toner added to the hopper from the top thereof passes into the mixing chamber in the housing 106 of development apparatus 30.

When assembled, the development apparatus 30 of the present invention also comprises the seal forming device 100 for forming a seal around the developer material or toner receiving aperture 114 of the receiving part 98. As such, the seal forming member 100 is also generally rectangular and includes a through-aperture 116 which corresponds in shape and cross-sectional area with the receiving aperture 114 of the part 98. When mounted around the aperture 114, the device 100 forms a seal thereat between the second part 98 and the lips, for example, the lips 118 of the toner container 102 when the container 102 is being moved in a loading direction as shown by the arrow 166 onto the aperture 114, and oppositely from the loading direction away from the aperture 114.

The container 102 contains replenishment developer material or toner that must be added to the mixing chamber of the development apparatus 30. As is well known in the industry, such addition or replenishment of developer material is necessary because the quantity of developer material (toner) held and used in the development apparatus for image development becomes depleted as a result of such development. As such, the higher the depletion rate of such developer material, the higher the frequency of such replenishment. As shown inverted, the toner or developer material container 102 includes a material containing portion 120 having an end or bottom portion for holding a replenishment supply of developer material which may be only toner particles or toner and carrier particles. The container 102 also includes a top portion 124 having a mouth or opening 126. The mouth or opening 126 is surrounded by flanged lips 118 that are adapted for cooperating with the receiving part 98 and the seal forming device 100 when the container 102 is being loaded, being held, and being unloaded with respect to the receiving aperture 114.

Figure 3:
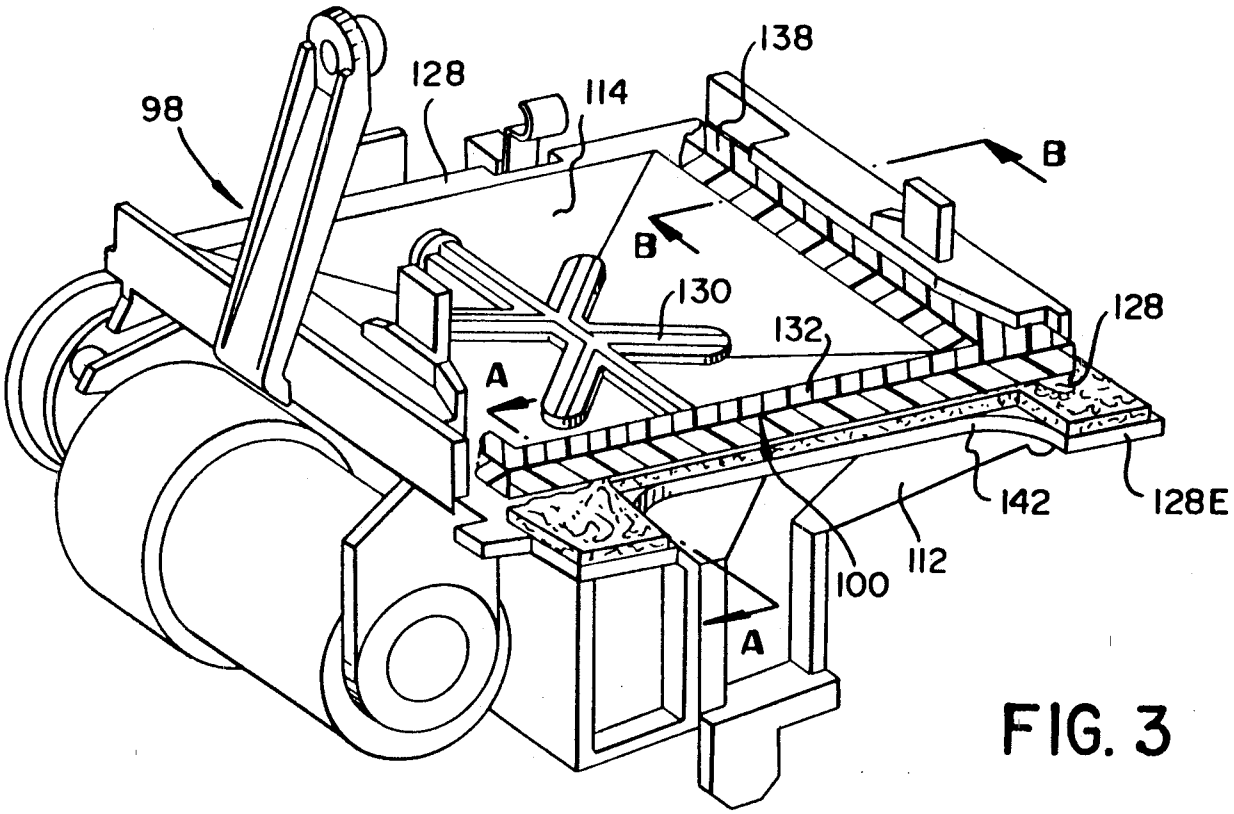
FIG. 3 is an enlarged perspective of the developer receiving part of the development apparatus of FIG. 3 partially including a cut-away portion of the seal forming device of FIG. 2.
Figure 4:
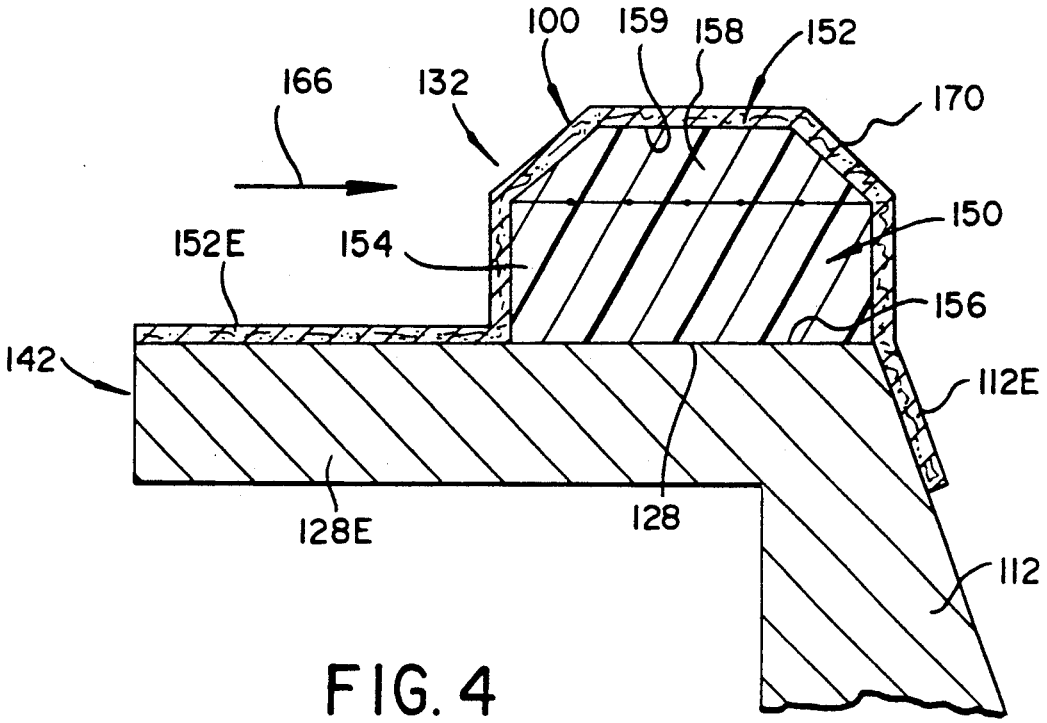
FIG. 4 is a cross-section of the top portion of the developer receiving part of FIG. 3 taken along the view plane A—A (FIG. 3) and including the front portion thereat of the seal forming device of the present invention.
Figure 5:
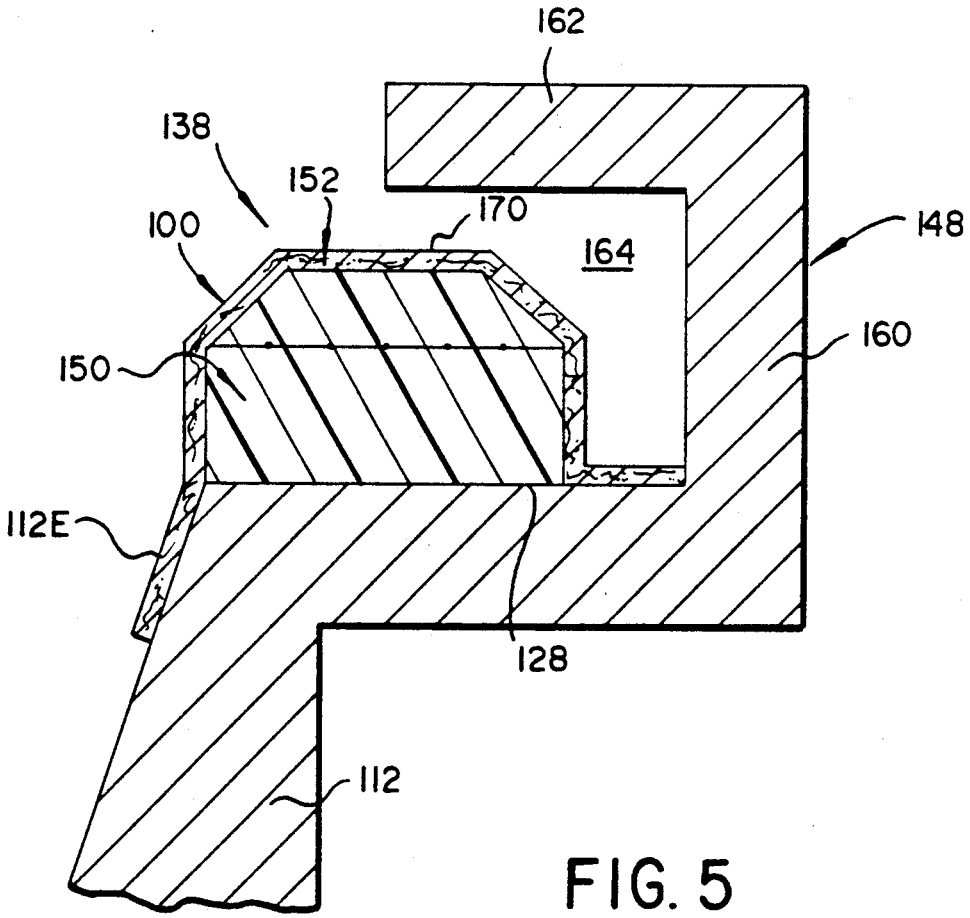
FIG. 5 is a cross-section of the top portion of the developer receiving part of FIG. 3 taken along the view plane B—B (FIG. 3) and including the side portion thereat of the seal forming device of the present invention.

Referring now to FIGS. 3–5, aspects of the receiving part 98 of development apparatus 30, and of the seal forming device 100 of the present invention are shown in greater detail. The receiving part 98 has a marginal surface area 128 which surrounds the developer material receiving aperture 114, and a through passage 130 at the bottom thereof for developer material to flow from the hopper portion 112 of part 98 into the mixing chamber of the first part 104 of development apparatus 30. Seal forming device 100 (shown partially in FIG. 3) is mounted onto the surface 128 such that the through-aperture 116 therein overlies toner receiving aperture 114 in receiving part 98. As shown, seal forming device 100 has a front side 132, a rear side 134, and left and right sides 136, 138 respectively (FIG. 3), which correspond to front, rear, left and right sides 142, 144, 146 and 148, respectively, of the toner receiving part 98. The front side 142 of the part 98 includes a forward extension 128E of the surface area 128 that is used to facilitate placement of the lips 118 of a container to be loaded onto the development apparatus 30.

As shown in FIGS. 4–6B, the seal forming device 100 comprises a resilient member 150 mounted onto the surface 128 of the toner receiving part 98 and around the toner receiving aperture 114, and a woven fabric 152. The resilient member 150 is preferably a foam material such as ROGERS PORON 4701-59-20125-1648(a polyurethane foam manufactured by Rogers Corporation of Woodstock Conn.). The foam or resilient member 150 is mounted to each of, and between the fabric 152 and the toner receiving part 98. In general, the resilient member or foam member 150 has a generally rectangularly shaped lower portion 154 including a base surface 156 that is mounted to the receiving part 98, for example, with a double sided adhesive tape (not shown). In order to reduce loading and unloading friction forces, and for the resilient member 150 to tend to retain its physical integrity, such member 150 has a generally trapezoidal upper portion 158 including a horizontal top surface 159 for mounting (also using double face adhesive tape) to the under face of the fabric 152. As such, the horizontal top surface 159 of the upper portion is narrower than the base surface 156 of the lower portion 154.

The trapezoidal upper portion 158 may be formed by diagonally (in a top-to-side direction) cutting and removing otherwise rectangular top edges of the member 150. Preferably, such a top portion should be formed by compressing such otherwise rectangular top edges of the member 150 into truncated shapes, as shown, by using extensions of the fabric 152 beyond the portion thereof that is mounted to the horizontal surface 159. As such, each such extension of fabric to either side of the top surface 159 is pulled downwards towards the bottom portion 154 of the member 150 thereby compressing an otherwise rectangular top edge. The fabric extension as pulled is then mounted in such a pulled-state to the surfaces (slanted and vertical) of the member 150 which adjoin the top surface 159. Finally, the extension as pulled is also mounted to a part of the receiving part 98 while the otherwise rectangular edges are still in such compression. As shown in FIG. 4, with respect to the fronts 132, 142, such a fabric extension for example 152E, is mounted over the surface extension 128E, and another such extension, for example 112E, is attached or mounted against a side wall into the hopper portion 112 of the part 98.

The rear, left and right (FIG. 5) sides 134, 136 and 138 of the seal forming device 100 similarly comprise a resilient member 150 also structured as described above, as well as the fabric 152 for mounting to a top horizontal surface thereto respectively and then down to the receiving part 98. As further shown, the sides 146, 148 of the receiving part 98 include an outside edge vertical member 160 (FIG. 5) adjoining the marginal surface 128, and a back-extending horizontal member 162 that is spaced from the surface 128 for defining a horizontal receiving and retaining groove 164 for the lips 118 of a toner container such as the container 102 (FIG. 2).

Figure 6A:
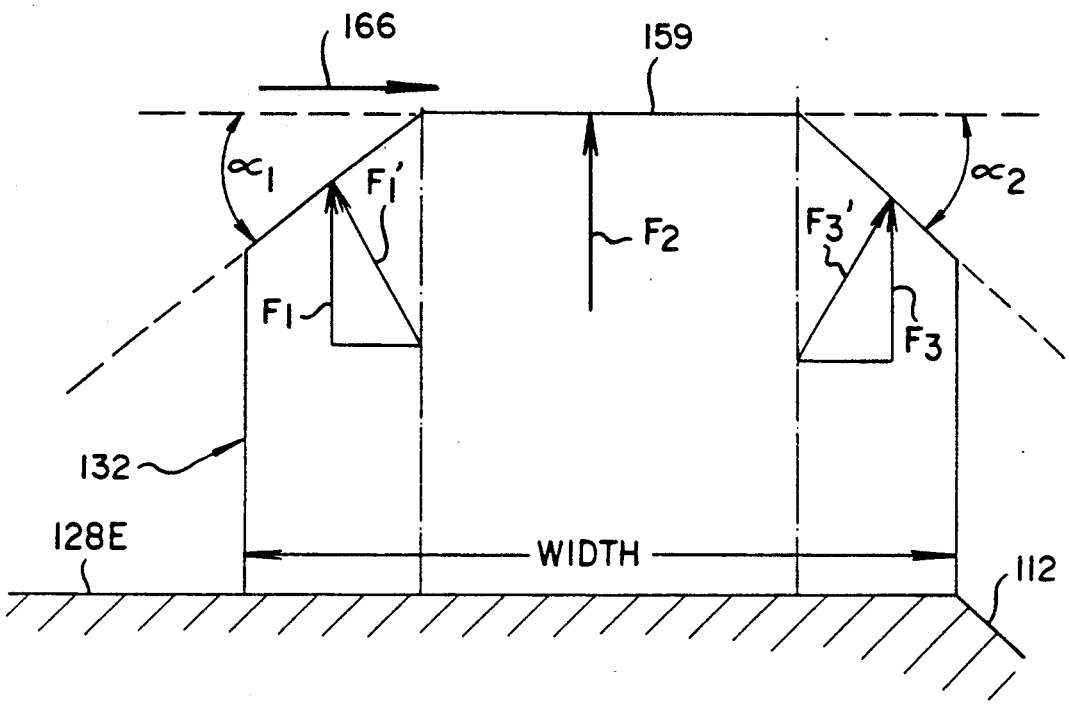
FIG. 6A is a schematic of the cross-section of FIG. 4 illustrating the forces acting on a container being loaded and unloaded against the seal forming device thereof.
Figure 6B:
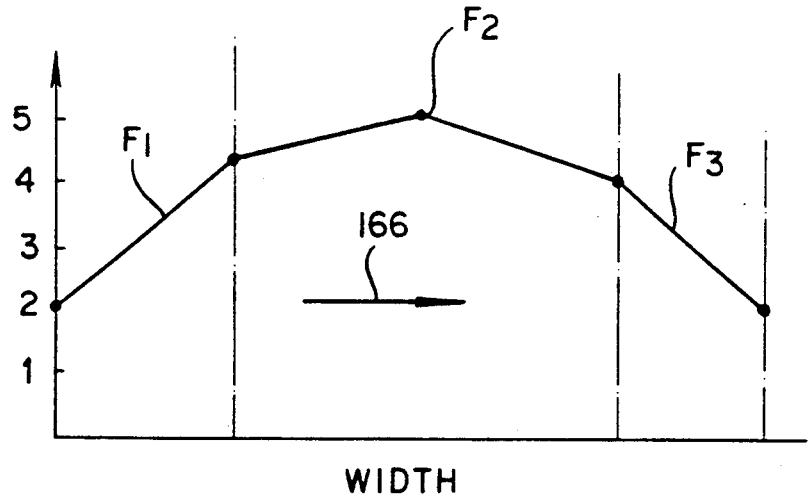
FIG. 6B is a graph of the force patterns of FIG. 6A.

A container such as 102 is loaded onto the seal forming member 100 (mounted as above) in the direction of the arrow 166 (FIGS. 4 and 6A). The unloading direction is therefore simply opposite to that of the arrow 166. For example, when the thickness of the container lips 118 is about 0.098 in., and the height of the receiving groove 164 is about 0.216 in., the maximum height of the resilient member 150 when mounted on the surface 128 should be about 0.118 in. For ease of loading and unloading such a container, the top otherwise rectangular edges should be formed, or deformed as described above, particularly those of the front and rear portions 132, 134 thereof, so as to be inclined with respect to the horizontal top surface 159 at a front angle $\alpha_1$ of about 30° and similarly at a rear angle $\alpha_2$ of 30°, respectively. The angles of inclination $\alpha_1$ and $\alpha_2$, of course, can also be unequal. The design is such that the further compression of the front and rear portions 132, 134 during the loading and unloading of a container such as 102, will generate loading and unloading forces $F_1$, $F_2$, $F_3$, the normal components $F_1'$, $F_2$ and $F_3'$ of which should range from an initial of two pounds (2 lbs.) over the inclined area, to a maximum of five pounds ( 5 lbs.) in the intermediate and sealing area, that is, the top horizontal area 159 thereof (FIG. 6B).

Figure 7:
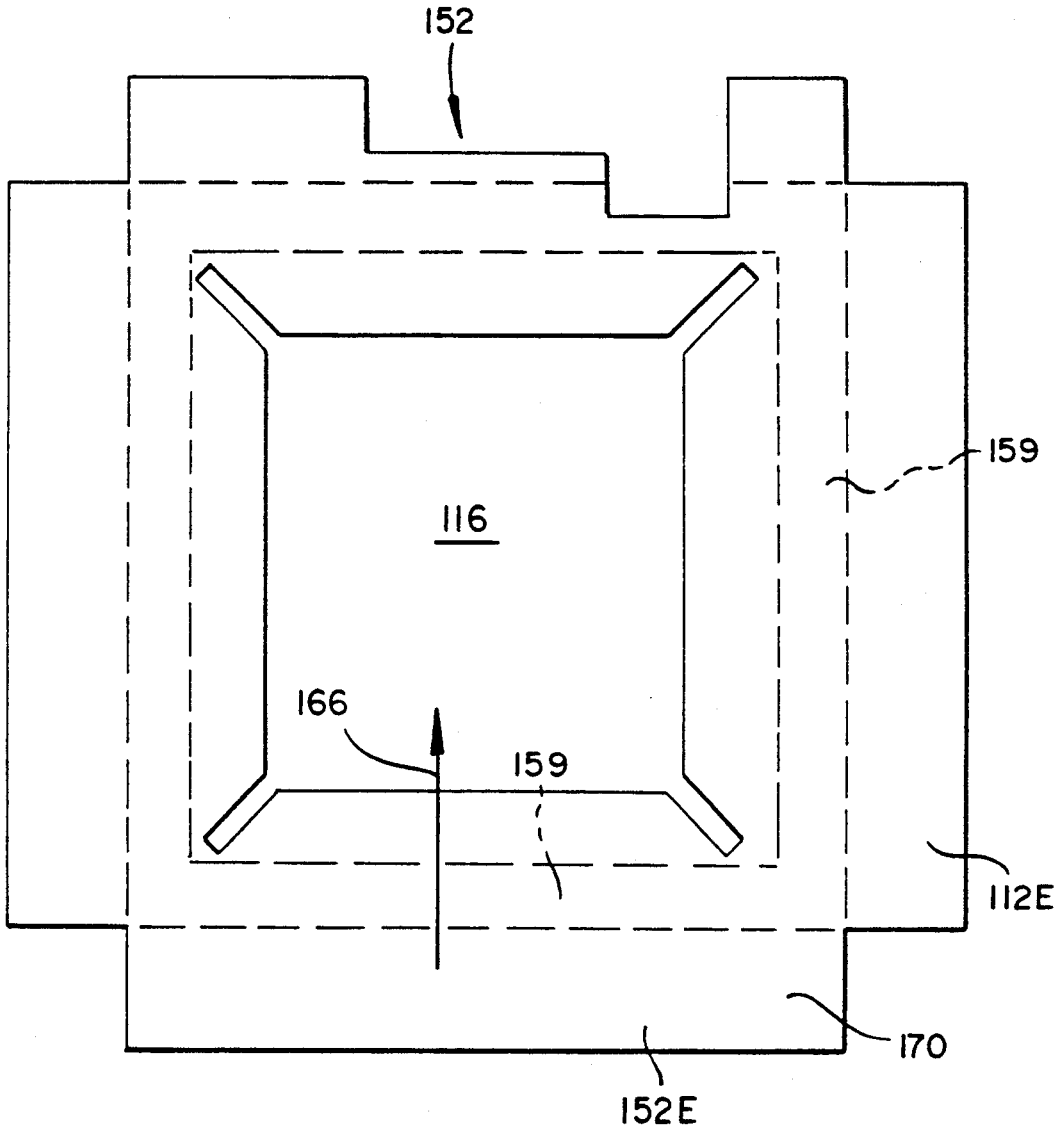
FIG. 7 is a top view of the fabric of the seal forming device of the present invention mounted only to the top horizontal surface of the resilient member thereof.
Figure 8A:
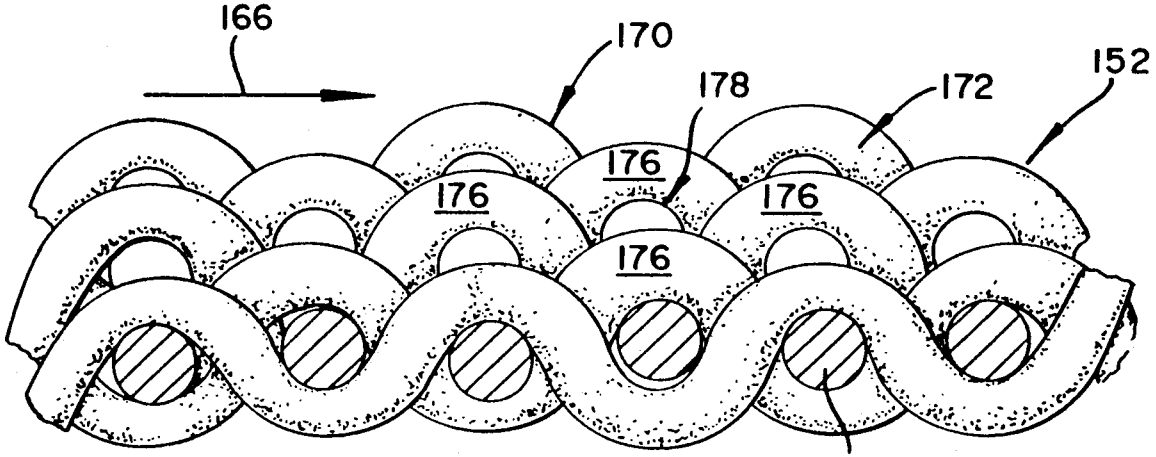
FIG. 8A is an enlarged perspective of a portion of the surface of the fabric of FIG. 7 showing the high and low areas thereto.
Figure 8B:
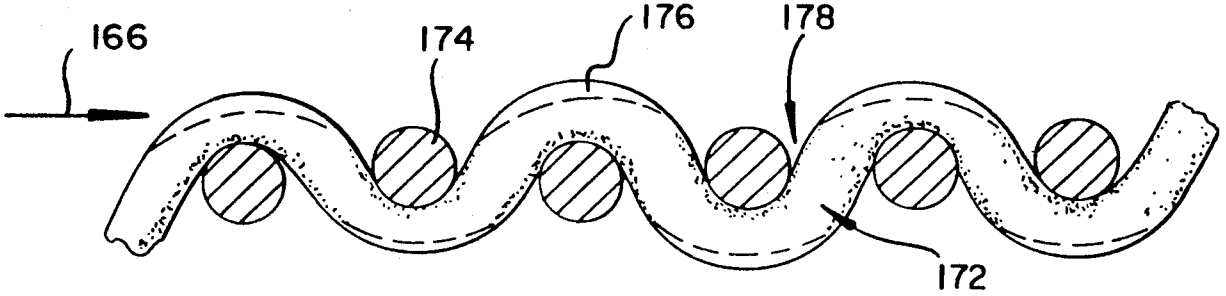
FIG. 8B is an enlarged, isolated warp fiber of the fabric of FIG. 8 illustrating its compressive and resilient character.

Referring now to FIGS. 7, 8A and 8B, the fabric 152 of the present invention is, for example, a woven symphony taffeta, a 100% dacron polyester fabric having warp and filling fibers shown as 172, 174, respectively. As clearly shown and labelled, the warp fibers 172 are the wavy and undulating fibers in the fabric that are generally spaced apart from each other, and that have a generally wavy or undulating and flowing path in the fabric. On the other hand, the filling fibers 174 are the generally straight and warp transversing fibers in the fabric that are generally and consecutively compacted one against the other, and that have a generally and comparatively straight path in the fabric. The fabric 152 is cut into a pattern as shown in FIG. 7 from a panel of such material, and is mounted onto the resilient member 150 as described above, to form a loading and unloading contact fabric surface 170 for the lips 118 of the toner container 102. In order to reduce the actual area of contact as well as the friction forces between the fabric surface 170 and the contacting lips 118, the warp fibers and filling fibers are made unequal in cross-sectional area. The result is a fabric surface 170 that has high areas 176, and low areas 178. The weave preferably is a plain weave in which each filling fiber is woven successively over and under each warp fiber, and in which adjacent filling fibers alternate in the over and under pattern with respect to the warp fibers. Additionally, it is preferable that the warp fibers, that is, the wavy and undulating fibers (as shown) be larger and heavier than the filling, that is, generally straight and consecutively contacting fibers, and that filling fibers be highly packed (as by beating) against one another into a dense mass thereby giving the fabric a matt finish. Woven, as such, the low areas 178 of the surface 170 are generally each completely surrounded by adjacent high areas 176 (FIG. 8A).

When being mounted to the resilient member 150 for subsequent mounting to the receiving part 98, the fabric 152 should be mounted such that the larger, wavy and undulating warp fibers 172 will lie or run in the loading and unloading direction as shown by the arrow 166. This allows each such larger, warp fiber 172 (which contacts the lips 118) to appear to flow forwardly and backwardly when compressed during such loading and unloading (FIG. 8B). During use, the low areas 178 on the surface 170 of the seal device 100 collect toner particles and become filled with such toner particles (FIGS. 8A, 8B). Due to known characteristics of toner, the toner particles therein then begin to act as a lubricant thereby further reducing the container loading and unloading friction forces between the lips 118 and the surface 170.

As can be seen, a device has been provided for forming a seal around the replenishment toner receiving aperture of a development apparatus comprising a resilient member 150 and a fabric 152 mounted to the member 150. The resilient member 150 is structured so as to minimize forces required for loading and unloading a container thereover, and such that it retains its physical integrity even under frequent use. The fabric has a particular weave including warp fibers which are larger than the filling fibers, and which are mounted to run in the loading and unloading direction. As a result, the loading and unloading of a replenishment toner container thereover is easy to accomplish.

The invention has been described in detail with particular reference to preferred embodiments thereof, but it will be understood that variations and modifications can be effected within the spirit and scope of the invention.

What is claimed is:

1. A device for forming a seal between a toner receiving part of an electrostatographic development apparatus having a toner receiving aperture and lips of a toner container being loaded onto and unloaded from the toner receiving aperture, the seal forming device comprising:

(a) a resilient member to be mounted onto a surface of the toner receiving part and around the toner receiving aperture; and (b) a woven fabric mounted onto said resilient member for forming a loading and unloading contact surface with the lips of the toner container, said fabric having wavy and undulating fibers forming said contact surface and generally straight fibers, said generally straight fibers each having a different and smaller cross-sectional area from that of each said wavy and undulating fibers for creating a fabric surface having low areas and high areas.

2. The seal forming device of claim 1 wherein said resilient member is foam.

3. The seal forming device of claim 1 wherein said generally straight fibers of said fabric are each alternately woven successively over and under each of said wavy and undulating fibers.

4. The seal forming device of claim 1 wherein said generally straight fibers are highly and consecutively packed against one another into a dense mass thereby giving said fabric a matt finish.

5. A device for forming a seal between a toner receiving part of an electrostatographic development apparatus having a toner receiving aperture and lips of a toner container being loaded onto and unloaded from the toner receiving aperture, the seal forming device comprising:

(a) a fabric for forming a loading and unloading contact surface with the lips of the toner container; and (b) a resilient member to be mounted to and located between said fabric and said toner receiving part, said resilient member having:

(i) a generally rectangular lower portion including a base surface to be mounted to said toner receiving part; and (ii) a generally trapezoidal upper portion including a top surface mountable to said fabric, said top surface being shorter than said base surface.

6. The seal forming device of claim 5 wherein said resilient member is foam.

7. The seal forming device of claim 6, wherein said trapezoidal upper portion of said resilient foam member is formed by compressing otherwise rectangular top edges of said upper portion into truncated shapes by using said fabric mounted to said top surface thereof.

8. The seal forming device of claim 7 wherein said fabric used in compressing said otherwise rectangular top edges of said upper portion of said resilient foam member is mounted to surfaces of said resilient foam member adjoining said top surface and then to the toner receiving part with said otherwise rectangular top edges still in compression.

9. A development apparatus for holding and using developer material to develop latent images in a copier or printer, the development apparatus comprising:

(a) a first part for holding, mixing and applying developer material to the latent images;

(b) a second part, connected to said first part, for receiving developer material, said second part including a developer material receiving aperture; and (c) a device forming a seal around said developer material receiving aperture and between said second part and lips of a developer material container being moved in a first loading direction into a loaded position over said receiving aperture, and oppositely in a second and unloading direction away from said receiving aperture, said seal forming device including:

(i) a resilient member for mounting onto the second part around said developer material receiving aperture; and (ii) a woven fabric mounted onto said resilient member for forming a loading and unloading contact surface with lips of the developer material container, said fabric having wavy and undulating fibers forming said contact surface and generally straight fibers, and said fabric being mounted onto said resilient member such that said wavy and undulating fibers run in said loading and unloading directions, and said wavy and undulating fibers are each larger in cross-section than each of said generally straight fibers.

10. The development apparatus of claim 9 wherein said wavy and undulating and said generally straight fibers form a surface finish to said fabric having low areas, and high areas, said high areas surrounding said low areas.

* * * * *